US006138813A

United States Patent [19]

Lamb, Jr. et al.

[11] Patent Number: 6,138,813

[45] Date of Patent: Oct. 31, 2000

[54] COIN MECHANISM WITH A PIEZOELECTRIC FILM SENSOR

[75] Inventors: Robert C. Lamb, Jr., Springfield; William C. Wolffe, Valley Forge; Robert B. Speers, West Chester, all of Pa.; John L. Tansky, Sr., Sewell, N.J.

[73] Assignee: Mars, Incorporated, McLean, Va.

[21] Appl. No.: 09/324,673

[22] Filed: Jun. 3, 1999

[51] Int. Cl.[7] ..... G07D 5/08

[52] U.S. Cl. ..... 194/317

[58] Field of Search ..... 194/317

[56] References Cited

U.S. PATENT DOCUMENTS

| | | | |
|---|---|---|---|
| 3,918,563 | 11/1975 | Schwippert et al. . | |
| 4,733,766 | 3/1988 | Roberts et al. | 194/240 |
| 4,848,556 | 7/1989 | Shah et al. | 194/212 |
| 5,407,049 | 4/1995 | Jacobs | 194/317 |
| 5,407,051 | 4/1995 | Wohlrab . | |
| 5,469,952 | 11/1995 | Kershaw et al. . | |

FOREIGN PATENT DOCUMENTS

| | | |
|---|---|---|
| 0 725 374 A2 | 8/1996 | European Pat. Off. . |
| 645201 | 9/1984 | Switzerland . |
| 661350 | 7/1987 | Switzerland . |

OTHER PUBLICATIONS

G.R. Crane, "Poly (vinylidene) Fluoride Used for Piezoelectric Coin Sensors," IEEE Trans. on Sonics and Ultrasonics, vol. SU–25, No. 6, pp. 393–395 (Nov. 1978).

*Primary Examiner*—Dean J. Kramer
*Assistant Examiner*—Bryan Jaketic
*Attorney, Agent, or Firm*—Fish & Richardson P.C.

[57] ABSTRACT

A coin mechanism includes a piezoelectric film sensor in contact with a coin debounce device. When a coin is inserted into the coin mechanism, the coin strikes the coin debounce device as it travels along a coin path. Micro-movement of the coin debounce device is sensed with the piezoelectric film sensor. The coin mechanism changes from a quiescent mode of operation to an active mode of operation in response to sensing the presence of the coin in the coin path. Coin recognition can then be performed. Overall power consumption of the coin mechanism can be reduced.

31 Claims, 9 Drawing Sheets

COIN MECHANISM WITH A PIEZOELECTRIC FILM SENSOR

BACKGROUND

The present invention relates in general to a coin mechanism with a piezoelectric film sensor.

Low average power consumption is desirable in various coin-operated devices such as pay telephones, vending machines and parking meters. Such devices typically include a coin mechanism for determining whether an inserted coin or token is genuine and for determining the denomination of the inserted coin or token. While the coin mechanism must be ready for use at all times, the coin mechanism can consume a significant amount of power when not in use. Moreover, where a battery or other low power source serves as the primary source of power, the continual power drain reduces the lifetime of the power source, thereby increasing the frequency at which the power source must be replaced.

A number of techniques have been devised to reduce the electrical power consumption of coin-operated devices. For example, U.S. Pat. No. 4,733,766, assigned to the assignee of the present invention, discloses a technique for leaving electrical power-consuming aspects of a coin checking apparatus unpowered when the apparatus is not being used. A piezoelectric ceramic element is arranged such that insertion of a coin into the apparatus stresses the piezoelectric ceramic element and produces a corresponding voltage. As explained in the foregoing patent, vibrations that occur upon impact of the coin with a snubber placed in the coin path stress the ceramic material sufficiently to generate the output voltage. The piezoelectric ceramic element can, therefore, be used to sense the arrival of the coin, and the generated voltage can be used to switch on the power of the apparatus.

While the use of piezoelectric ceramic sensors in coin mechanisms has been reasonably successful, several difficulties can arise. First, vibrations caused by events other than insertion of a coin into the coin mechanism can cause the piezoelectric ceramic sensor to generate a voltage and switch on the power. Switching on the power of the coin mechanism under such circumstances is, of course, undesirable. Second, the mechanical mounting of the piezoelectric ceramic sensor in the coin mechanism sometimes requires the use of an adhesive such as glue. Such mounting techniques can affect the mechanical-to-electrical energy conversion of the ceramic sensor, making the determination of whether power should be turned on more difficult. Third, some of the piezoelectric ceramic materials are sensitive to high temperatures. The properties of the ceramic can be degraded during soldering or other high temperature processes if proper care is not taken to protect the ceramic from damage. Additionally, the output signal generated by the piezoelectric ceramic sensor often requires the use of a front end amplifier circuit to provide a sufficiently high signal level. Such circuitry increases the overall cost of the coin mechanism and can increase the power consumption of the unit.

Accordingly, it is desirable to improve the techniques for sensing the insertion of a coin in a coin mechanism and to reduce the overall power consumption of such mechanisms.

SUMMARY

In general, in one aspect, a method of using a coin mechanism includes inserting a coin into the coin mechanism, causing the coin to strike a coin debounce device as it travels along a coin path, and causing a piezoelectric film sensor in contact with the coin debounce device to be deflected when the coin debounce device moves in response to being struck by the coin. An output signal from the piezoelectric film sensor is provided to indicate presence of the coin in the coin path. The coin mechanism is caused to change from a quiescent mode of operation to an active mode of operation in response to the output signal from the piezoelectric film sensor.

According to another aspect, a coin mechanism includes a coin path with a coin track and an energy transfer device having an upper surface arranged to be struck by a coin traveling along the coin path. A piezoelectric film sensor is in contact with the energy transfer device. When a coin strikes the energy transfer device, movement of the energy transfer device deflects the piezoelectric film sensor, thereby causing a change in an output signal from the sensor. The coin mechanism includes a circuit to process the output signal from the piezoelectric film sensor. The coin mechanism changes from a quiescent mode of operation to an active mode of operation in response to the output signal from the piezoelectric film sensor indicating the presence of a coin in the coin path.

Preferably, the energy transfer device which the coin strikes is a coin debounce device which reduces bouncing of the coin.

Various implementations can include one or more of the following features. The coin mechanism can include a coin identification sensor, positioned downstream of the coin debounce device, past which a coin travels as the coin moves along the coin track. The coin mechanism also can include a controller and power supply for providing power to the controller. Prior to receipt of a wake-up signal, the controller can operate in a quiescent or low-power mode. The controller receives a wake-up signal when the output signal from the piezoelectric film sensor indicates the presence of a coin in the coin path. In response to the wake-up signal, the controller changes from the low-power mode to a powered-up mode to allow coin validation functions to be performed. In some implementations, power from the supply is completely or substantially shut off from the controller until receipt of the wake-up signal. In that case, the power supply also receives the wake-up signal and provides power to the controller in response to receiving the wake-up signal.

An upper surface of the coin track can be substantially in line with the upper surface of the coin debounce device to allow the coin to travel past the coin identification sensor with little or no bounce. The piezoelectric film sensor can be mounted adjacent the coin debounce device such that a coin travelling along the coin path does not directly strike the piezoelectric film sensor.

The piezoelectric film sensor and the coin debounce device can be secured to the coin mechanism lid. For example, the piezoelectric film sensor and the coin debounce device can include substantially aligned holes for receiving a fastening rod, such as a bolt, screw or pin, to secure the piezoelectric film sensor and the coin debounce device to the lid. Also, a section of the piezoelectric film sensor can be supported by a ledge secured to the track side of the lid.

The lid of the coin mechanism can include a first slot through which a portion of the piezoelectric film sensor passes to a second side of the lid. Electrical connections from the piezoelectric film sensor to the circuit that processes the output signal can be connected to a section of the piezoelectric film sensor located on the second side of the lid. The section of the piezoelectric film sensor to which the electrical connections are connected can include a hole which fits over a projection on the second side of the lid to help retain the piezoelectric film sensor in place.

The piezoelectric film sensor can include multiple bends. For example, the piezoelectric film sensor can have a first section disposed between the coin debounce device and the lid and a second section adjacent a lower surface of the coin debounce device. The first section of the piezoelectric film sensor can include tabs to position the piezoelectric film sensor. Lugs can be molded to the first side of the lid for positioning the tabs of the piezoelectric film sensor. The second section of the piezoelectric film sensor can be supported by the ledge secured to the lid. The lid can have a second slot to help increase the amount of bending of the piezoelectric film sensor caused by micro-movement of the coin debounce device. For example, the second slot can be located adjacent the first section of the piezoelectric film sensor.

Various implementations can include one or more of the following advantages. Using a piezoelectric film sensor rather than a piezoelectric ceramic sensor can provide a coin arrival sensor which is less sensitive to vibrations caused by events other than insertion of a coin. Therefore, the piezoelectric film sensor makes it more likely that the coin mechanism will be powered up only when the presence of a coin is detected. The overall consumption of power can, therefore, be reduced. Providing multiple bends in the film sensor and multiple slots in the lid can help improve the sensitivity of the piezoelectric film sensor.

In some cases, the output signal from the piezoelectric film sensor can be processed without front end amplification circuitry to reduce the overall cost and power consumption of the coin mechanism even further. In addition, the piezoelectric film sensor can be placed out of the direct path of a coin traveling through the coin mechanism. That can reduce the wear of the sensor and extend its lifetime.

Techniques for mounting the piezoelectric film sensor are relatively easy, and can avoid some of the difficulties encountered in the use of ceramic sensors. Furthermore, by designing the piezoelectric film sensor so that it extends on both sides of the lid of the coin mechanism, the electrical connections to the piezoelectric film sensor can be made away from the coin track. Proper positioning and operation of the piezoelectric film sensor can be enhanced.

Other features and advantages will be readily apparent from the following detailed description, the drawings and the claims.

DETAILED DESCRIPTION

As used herein, the terms "coin" and "coins" include genuine coins, as well as tokens, slugs, and similar objects.

Figure 1:
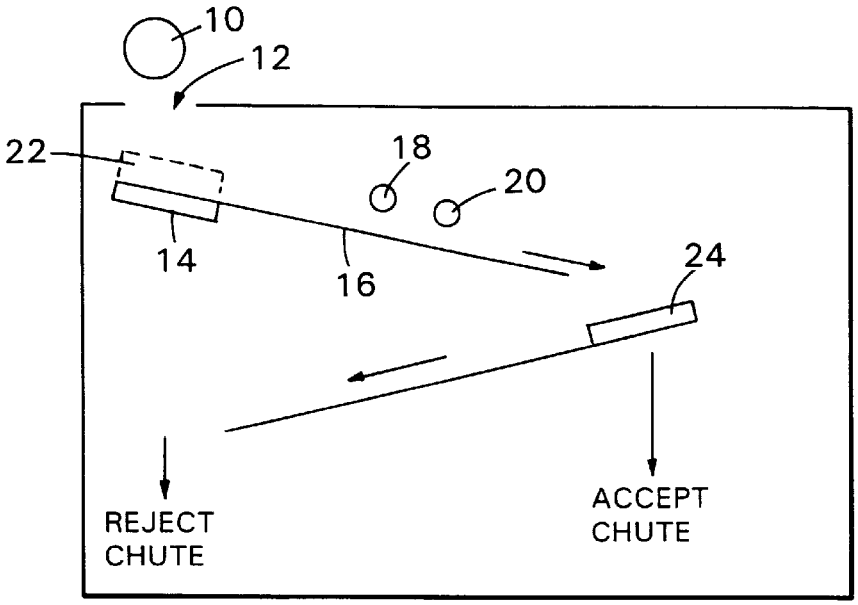
FIG. 1 is a simplified diagram of a coin mechanism according to the invention.

As shown in FIG. 1, a coin mechanism receives an inserted coin 10 through a coin entry 12. The coin falls onto a coin debounce device 14 which absorbs or dissipates most of the coin's kinetic energy so that the coin rolls substantially smoothly along a track 16 past electrically-powered coin identification sensors 18, 20. Such energy debounce devices are known in the art and sometimes are referred to as snubbers. In some implementations, the energy debounce device, or snubber 14, can comprise, for example, a piece of ceramic or a piece of sintered metal. In the illustrated arrangement, the snubber 14 causes a change in direction of the coin path and reduces bouncing of the coin as it travels along the coin track. A piezoelectric film sensor 22 is positioned adjacent the snubber 14 and is physically deflected by the snubber when it is struck by a coin 10. Thus, the piezoelectric film sensor 22 senses the arrival of the coin 10 and generates an output signal which causes a change in the amount of power provided to the coin mechanism and/or a microcontroller (not shown in FIG. 1) associated with the coin mechanism. In particular, prior to sensing a coin in the coin mechanism, the system is in a quiescent or low-power state, whereas when arrival of a coin is detected by the piezoelectric film sensor 22, the system is caused to power up.

As the coin 10 rolls past the sensors 18, 20, electrical signals are generated by the sensors and are provided to the microcontroller. The electrical signals generated by the coin identification sensors 18, 20 contain information corresponding to the measured characteristics of the coin, such as the coin's diameter, thickness, metal content and electromagnetic properties. The microcontroller can use the electrical signals to discriminate whether the coin 10 is acceptable, and if so, the denomination of the coin.

The coin 10 rolls down the track 16 and falls toward a gate 24 which is automatically retracted if the coin is found to be valid, so as to direct the coin along an accepted coin path or chute. If the coin 10 is not found to be valid, then the gate 24 is left in position so that the coin hits the gate and rolls off it to a reject path or chute.

Figure 2:
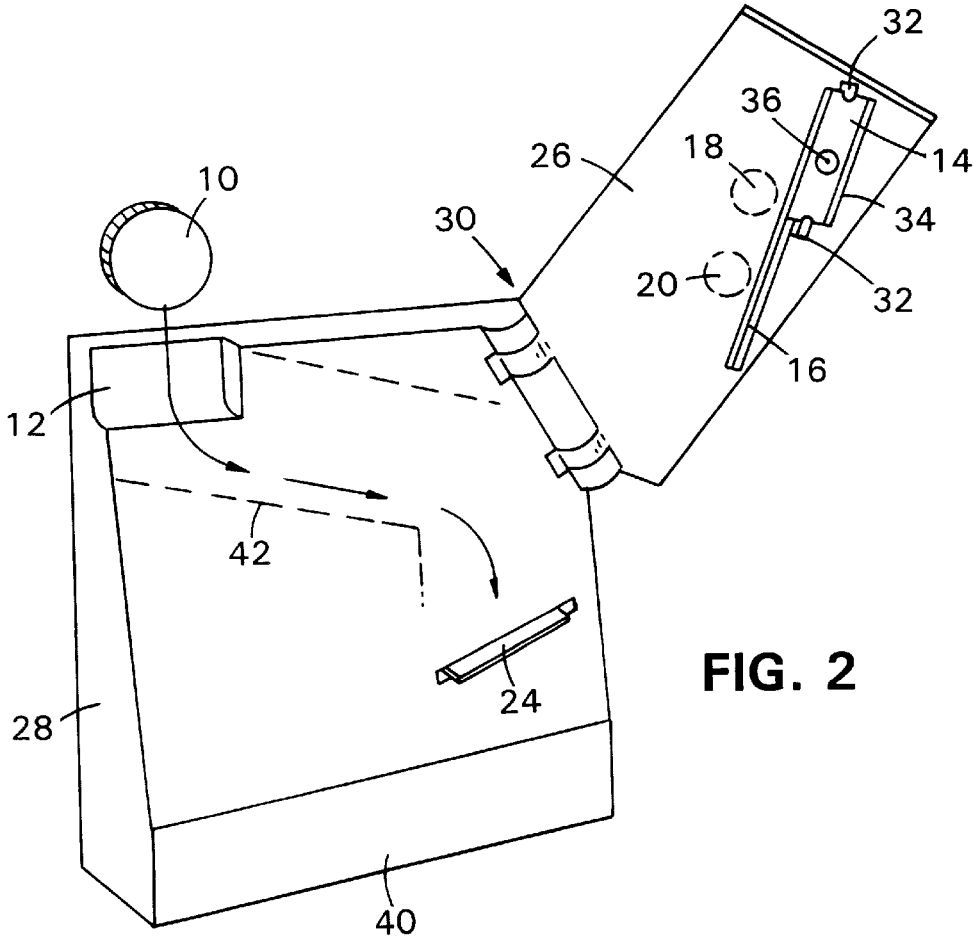
FIG. 2 illustrates the coin mechanism with its lid in an open position.
Figure 4:
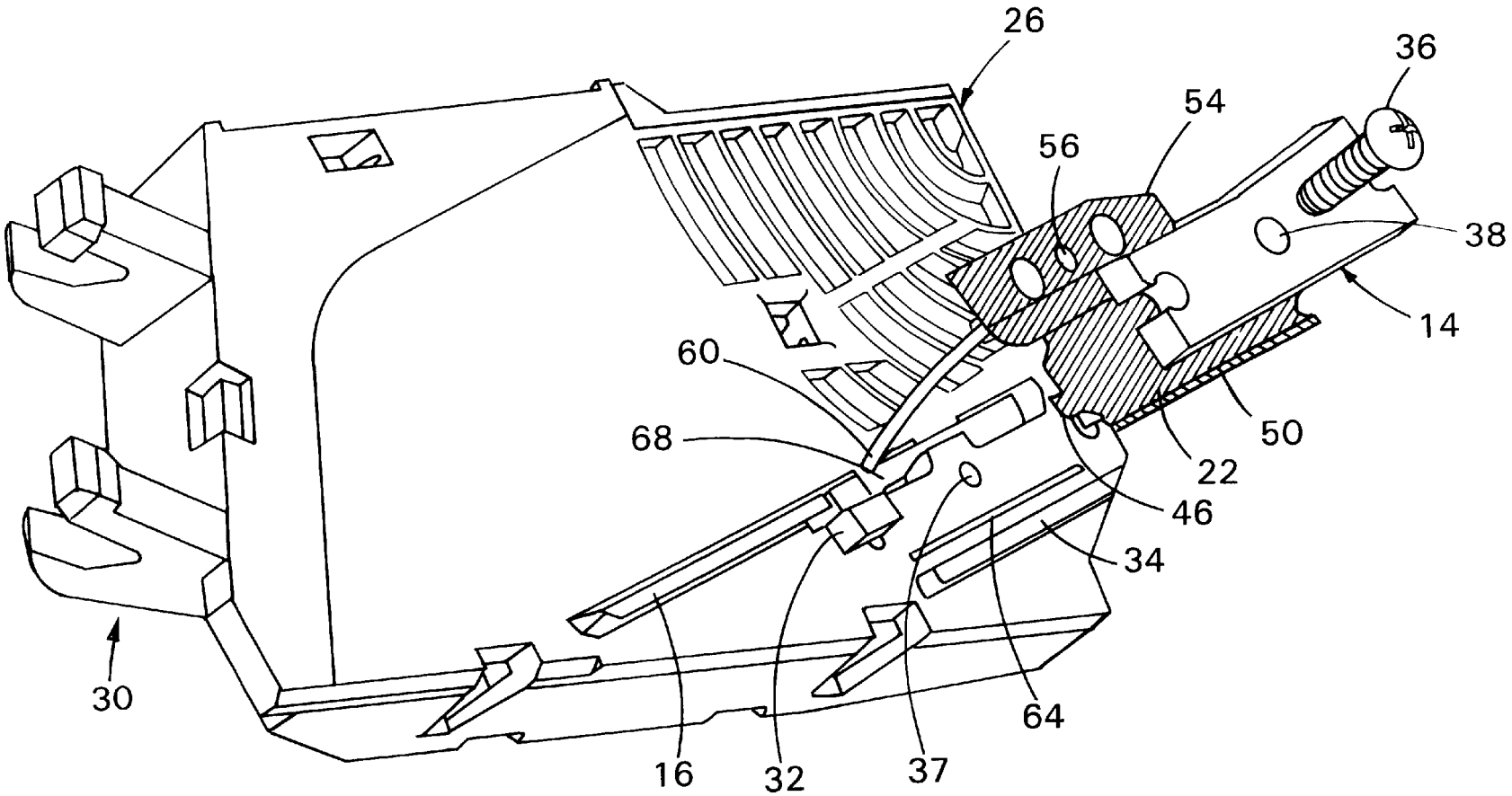
FIGS. 4 and 5 illustrate positioning of the piezoelectric film sensor in the coin mechanism as viewed from the track-side of the lid.

As shown in FIG. 2, the coin mechanism includes a lid 26 connected to a flight deck 28 by a hinge 30. Although the lid 26 is shown in an open position, it is closed during normal operation. The protruding and sloping coin track 16 can be molded or otherwise secured to the inside of the lid 26 as can be two locating lugs 32 and a ledge 34. The snubber 14, which can be made, for example, of a metal or ceramic material, is positioned near the upper end of the track 16. Recesses at either end of the snubber 14 fit around the lugs 32. The snubber 14 is positioned slightly above the ledge 34 and can be mounted to the lid 26 by a fastening rod 36 such as a screw, bolt or pin, which passes through a hole 38 (see FIGS. 4 and 5) in the snubber. The lid 26 has a corresponding pre-drilled bore 37 (see FIGS. 4, 6 and 7) for receiving the fastening rod 36. Although not visible in FIG. 2, the piezoelectric film sensor 22 is positioned adjacent the snubber 14, as described in greater detail below with respect to FIGS. 4 through 7.

When properly positioned, the upper surface of the snubber 14 is substantially in line with the upper surface of the coin track 16. During normal operation the lid 26 is closed, and the snubber 14 and coin track 16 lie against the front face 40 of the deck 28 as indicated by the broken line 42. The sensors 18, 20 are located downstream of the snubber 14 on the front side of the lid 26. The positions of the sensors 18, 20 are indicated in broken lines on the inside (or track-side) of the lid in FIG. 2.

To avoid excessive wear of the piezoelectric film sensor 22, it is preferably not positioned directly in the path of the coins. Rather, as previously mentioned, the sensor 22 is designed to be mounted adjacent the snubber 14 out of the path of a coin or similar object traveling through the coin mechanism. The piezoelectric sensor 22 is mounted in direct contact with the snubber 14 such that when the snubber 14 is struck by a coin 10 or similar object, micro-movement of the snubber physically deflects the sensor 22 to cause a change in the output signal generated by the sensor.

As shown in FIG. 3, in one implementation, the piezoelectric film sensor 22 includes a first section 44 which is positioned on the track-side of the lid 26 between the lid and the snubber 14. The first section 44 includes tabs 46 which are located at its side ends and which fit below the locating lugs 32 (see FIG. 5) to position the sensor 22 in place. The first section 44 also has a hole 48 which is substantially aligned with the hole 38 in the snubber. Thus, a single fastening rod 36 can be used to secure the snubber 14 and the piezoelectric film sensor 22 to the lid 26. A second section 50 of the sensor 22 is provided at the lower end of the first section 44 and forms a substantially right angle with the first section when secured to the lid by the snubber 14 and fastening rod 36. When positioned in place, the second section 50 of the piezoelectric film sensor 22 is supported by the ledge 34 (see FIG. 5). The snubber 14 then rests on the upper surface of the second section 50 which is supported directly by the ledge 34.

The sensor 22 also includes a curved third section 52 which is provided at the upper end of the first section 44. The third section 52 projects from the first section 44 in the opposite direction from the second section 50 and extends through a first slot 68 (see FIGS. 4 and 6) in the lid 26. A fourth section 54 projects from the third section 52 in a direction away from the first section 44 and in a plane substantially parallel to the first section 44. The fourth section 54 also has a hole 56 which fits over a projection 62 (see FIG. 7) formed on the sensor-side of the lid 26. The projection 62 also helps retain the sensor 22 in place. Two crimped lugs 57, 59 are attached to the fourth section 54 and provide the electrical connection to two wires or electrodes 58, 60 which lead to a printed circuit board with circuitry for processing the output from the sensor 22.

Figure 6:
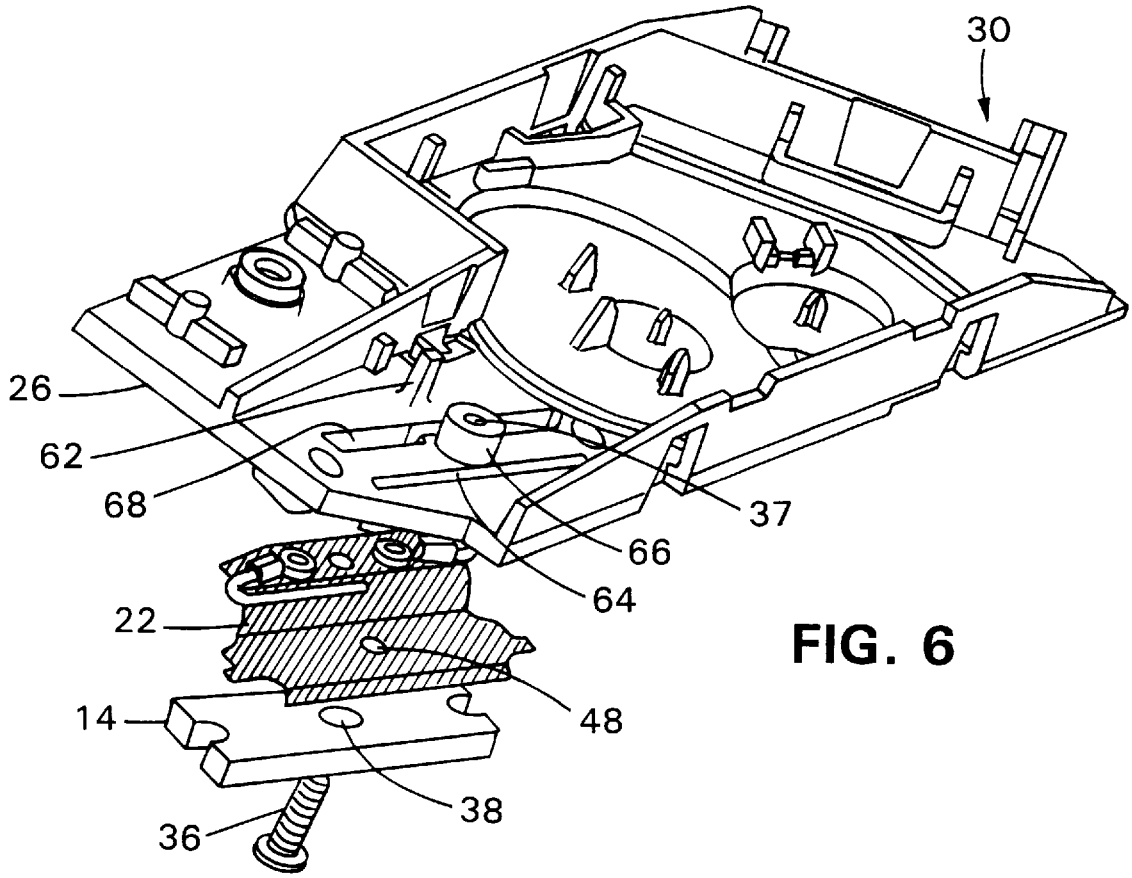
FIGS. 6 and 7 illustrate positioning of the piezoelectric sensor in the coin mechanism as viewed from the sensor-side of the lid.
Figure 7:
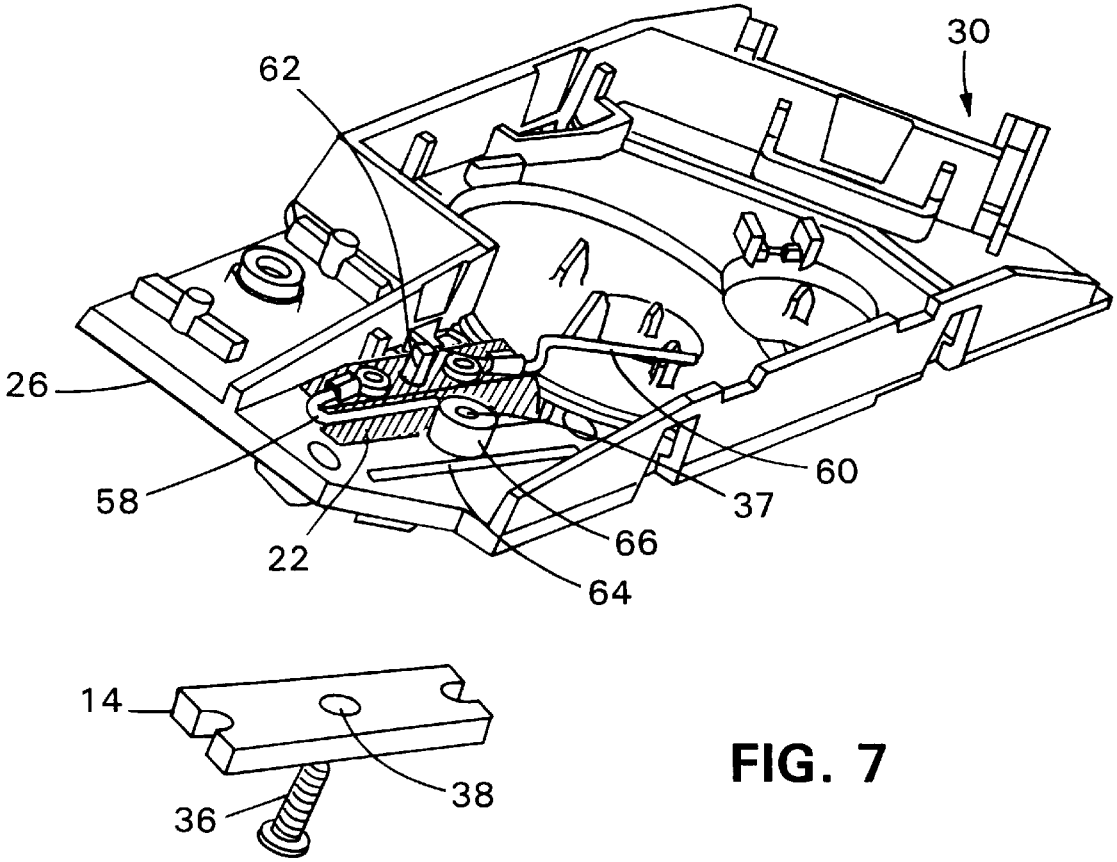

When properly positioned, the first and second sections 44, 50 of the sensor 22 are located on the track-side of the lid 26 (see FIG. 5), whereas the fourth section 54 is located on the opposite or sensor-side of the lid (see FIG. 7). As previously noted, the third section 52 extends through the slot 68. The lid 26 also includes a second slot 64 (see FIGS. 4, 6 and 7) below the first slot 68. The second slot 64, which is adjacent the sensor 22, can increase the deflection of the sensor 22 that results from micro-movement of the snubber 14 when it is struck by a coin 10. Similarly, providing multiple bends in the sensor 22 can increase its sensitivity. The sensitivity of the sensor 22 can, therefore, be improved.

As shown in FIG. 3, in one implementation the piezoelectric film sensor 22 includes several layers, including a thin polyvinylidene fluoride (PVDF) base film 80. In one implementation, the PVDF film 80 has a thickness of about 110 microns and is annealed at about 85° C. On one side of the PVDF film 80 a positive silver ink layer 82 is provided. A negative silver ink layer 84 is provided on the opposite side of the PVDF film 80. In some implementations, the positive and negative conductive layers 82, 84 cover substantially the entire surface of the PVDF film 80. However, the conductive materials also can be deposited in a pattern to help reduce the overall capacitance of the sensor 22 and improve its sensitivity. Exemplary patterns for the silver ink layers 82, 84 are illustrated in FIGS. 3C, 3D and 3E. FIGS. 3C and 3D show a positive silver ink pattern 82. Similarly, FIG. 3E shows a negative silver ink pattern 84 as seen from the side of the sensor 22 with the positive ink pattern. As can be seen from those figures, the conductive ink patterns 82, 84 are provided over the second section 50 and the third section 52 of the sensor 22 and extend over curved portions of the sensor. Preferably, the stretch direction of the PVDF film 80 is as indicated by the arrow 92 in FIG. 3D.

Figure 3A:
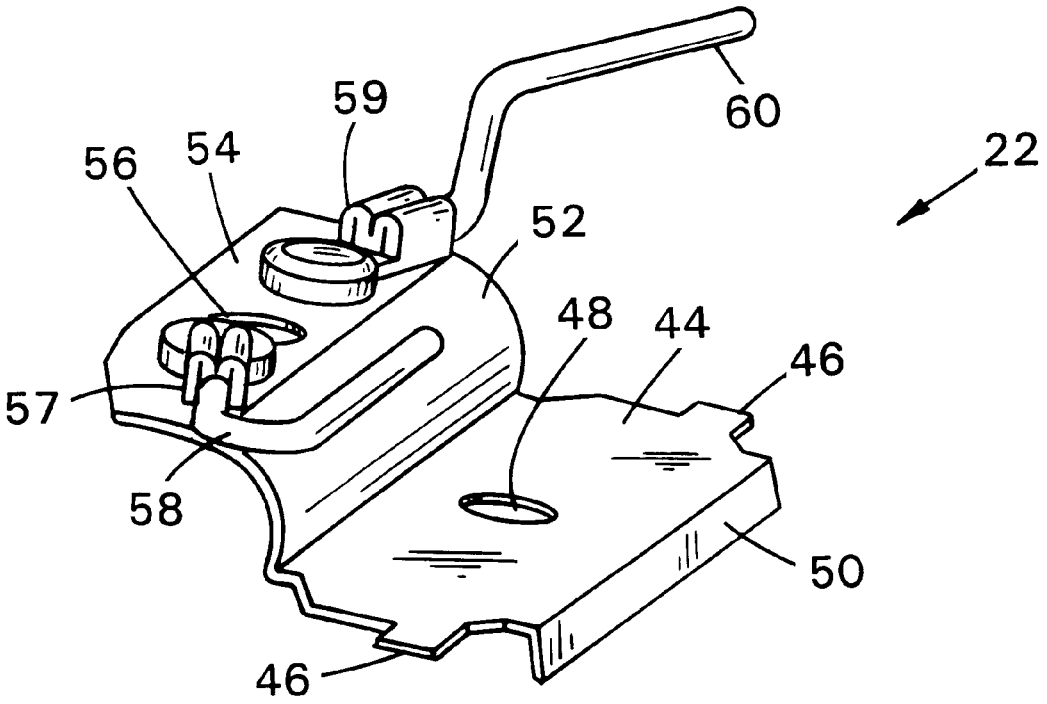
FIG. 3A illustrates an exemplary piezoelectric film sensor according to the invention.
Figure 3B:
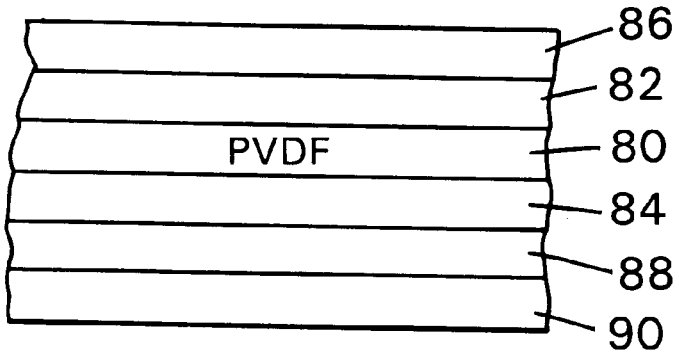
FIG. 3B illustrates layers of the piezoelectric film sensor according to one implementation.
Figure 3C:
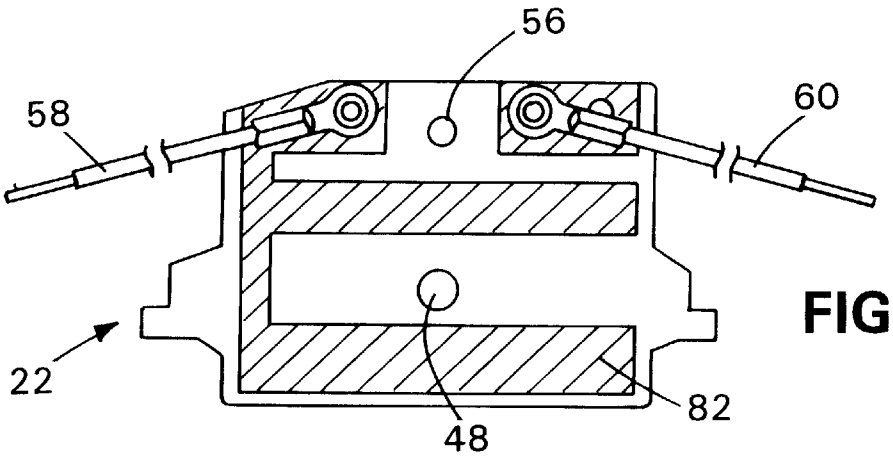
FIGS. 3C and 3D illustrate an exemplary pattern of a positive conductive layer in the piezoelectric film sensor.
Figure 3E:
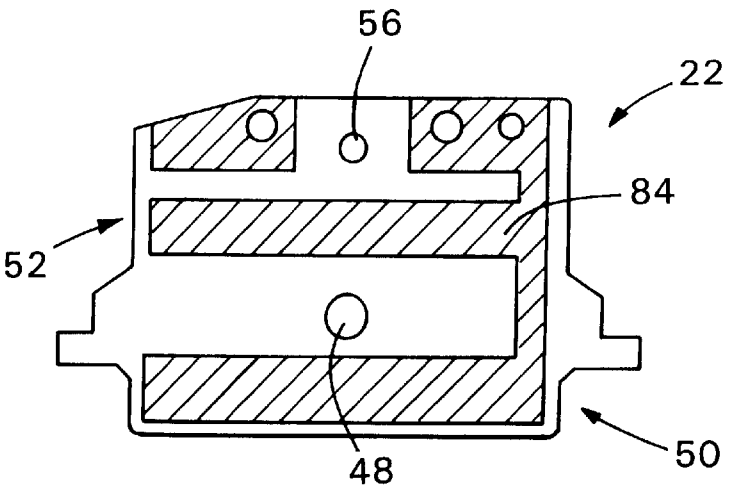
FIG. 3E illustrates an exemplary pattern of a negative conductive layer in the piezoelectric film sensor.
Figure 3D:
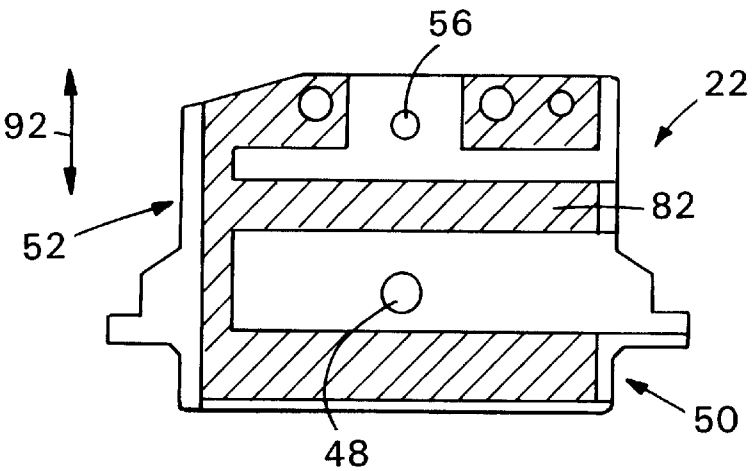

As further shown in FIG. 3B, a protective coating 86 is provided over the surface of the sensor with the positive ink layer 82. An adhesive layer 88 and a substrate layer 90 are provided over the surface of the negative ink layer 84. In one implementation, the adhesive layer 88 has a thickness of about 0.001 inches, and the substrate layer 90, which can include MYLAR, has a thickness of about 0.002 inches.

Figure 5:
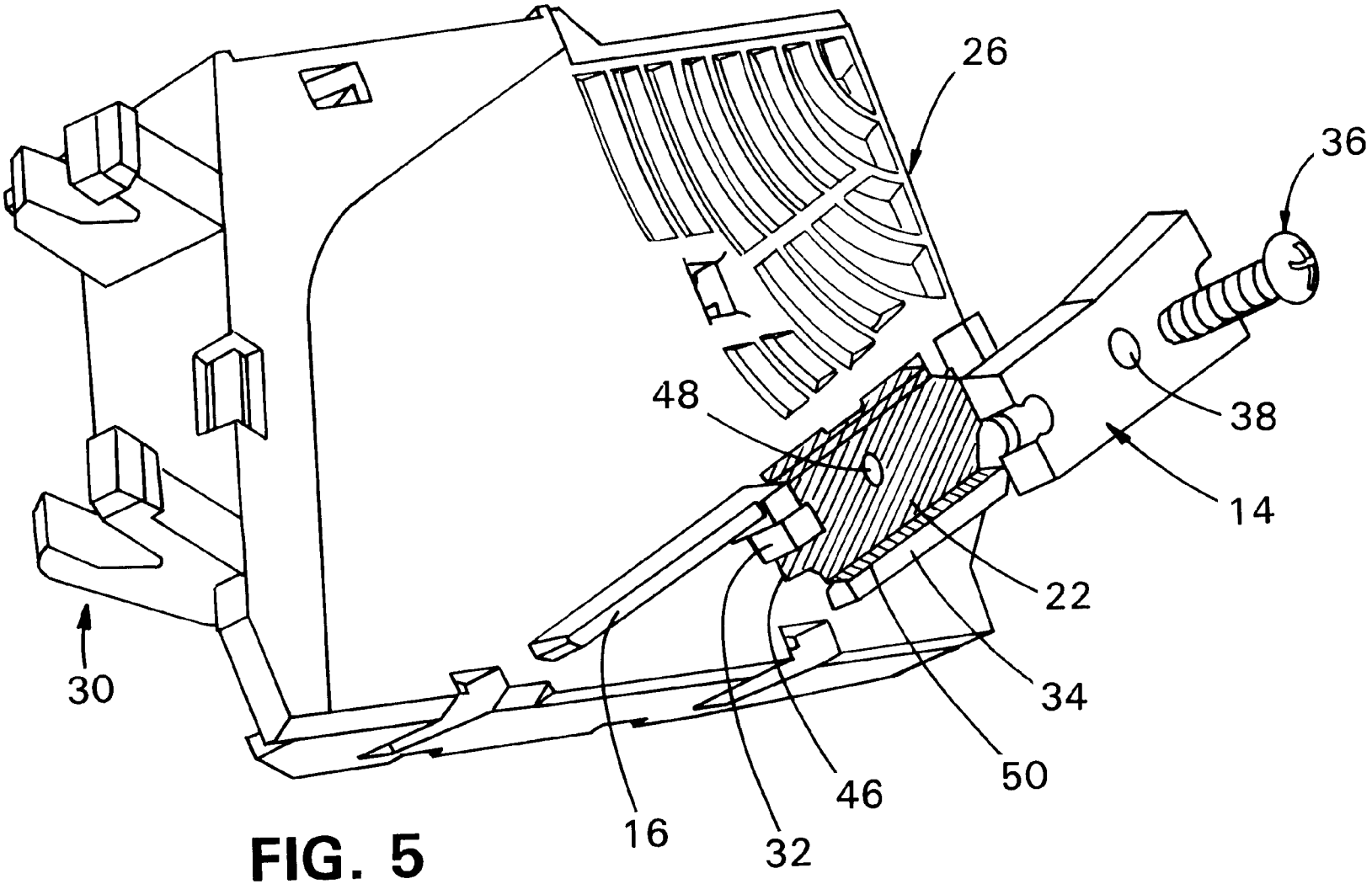

Initially, the sensor 22 can be substantially flat and is bent as shown in FIG. 3A when it is positioned in place. To position the piezoelectric film sensor 22 and secure it to the lid 26, the following sequence of steps can be performed. The sensor 22 is held on the track-side of the lid 26 and the fourth section 54 is guided through the slot 68 so that the fourth section appears on the sensor-side of the lid 26. The fourth section 54 then is bent upward so that it is positioned as shown in FIG. 7. The first and second sections 44, 50 are bent so that the sensor 22 appears as shown in FIG. 5. The snubber 14 then is positioned adjacent to the sensor 22 on the track-side of the lid 26, and the fastening rod 36 is inserted through the pre-drilled bore 37 to secure the piezoelectric film sensor 22 and the snubber 14 in place.

Figure 8:
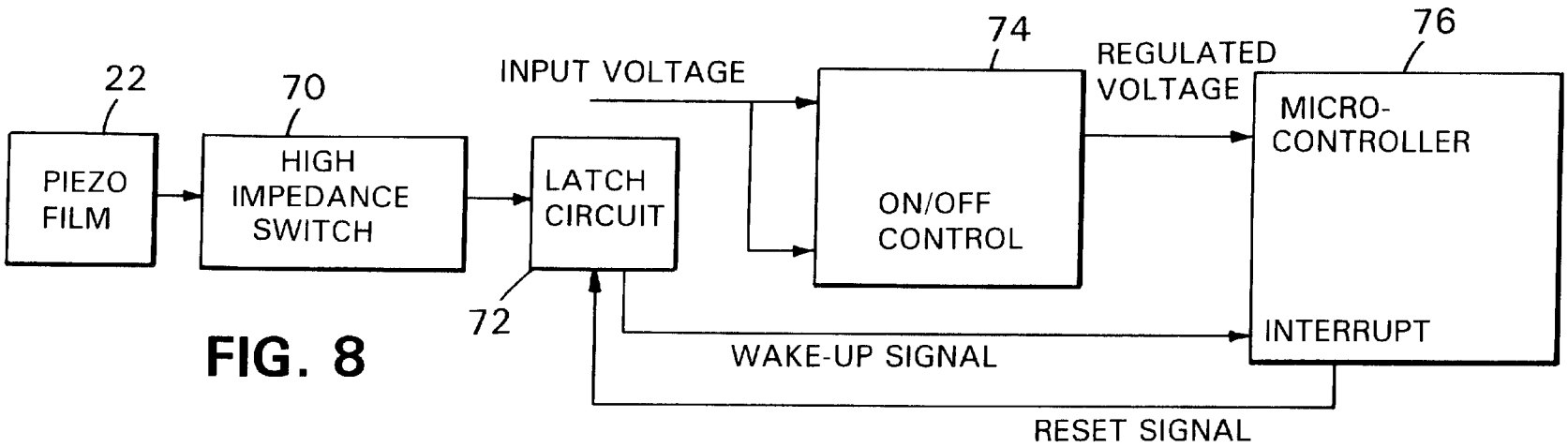
FIGS. 8 and 9 are block diagrams of circuits for processing signals from the piezoelectric sensor.

As shown in FIG. 8, the output of the piezoelectric film sensor 22 is provided to an input of a high impedance switch circuit 70. The switch circuit 70 can be any one of several types, including a transistor circuit, such as a field effect transistor or bipolar junction transistor circuit, or an integrated circuit, such as a comparator or CMOS logic gate. The output of the high impedance switch circuit 70 is provided to a latch circuit 72. When a coin impacts the snubber 14 such that the sensor 22 generates a corresponding output signal, the voltage appearing at the output of the switch circuit 70 is sufficient to switch the latch 72 from a reset condition to a set condition. The latch 72 remains in the set condition after the transient output signal from the piezoelectric film sensor 22 has terminated. When set, the latch 72 provides a wake-up signal which is used to switch the power of the system from a low-power or quiescent mode to an active or powered-up mode. In the implementation shown in FIG. 8, a regulated voltage is continuously provided by a voltage regulator 74 to the microcontroller 76 associated with the coin mechanism. The wake-up signal from the latch 72 is provided to an input of the microcontroller 76 which causes the microcontroller to power up. As a result of the wake-up signal, power also is provided to other elements of the coin mechanism, such as the coin identification sensors 18, 20, so that coin validation functions can be performed. Once the microcontroller 76 completes the coin validation and related processes, it resets the latch 72 and enters the low-power mode again. In some cases, the microcontroller 76 is programmed to wait a predetermined period of time prior to entering the low-power mode. If additional coins are inserted into the coin mechanism within the predetermined period, the microcontroller is already powered up.

Figure 9:
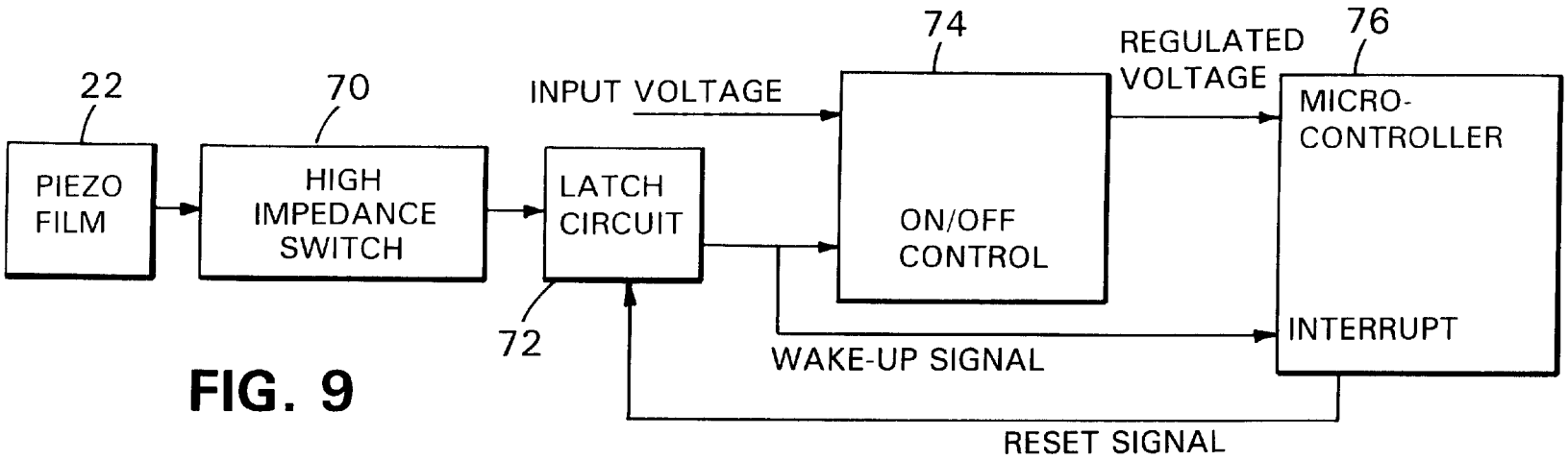

In an alternative implementation illustrated in FIG. 9, the wake-up signal from the latch 72 also controls the output of the voltage regulator 74. Thus, the voltage regulator 74 is turned on to provide the regulated output voltage only when the latch 72 is set, in other words, after the piezoelectric film sensor 22 senses the presence of a coin in the coin mechanism. After completing the coin validation and related processes, the microcontroller 76 clears the latch 72. The system then returns to its low-power or quiescent mode, and the regulated voltage is shut off from the system. Thus, during the low-power mode, power is supplied only to the high impedance switch circuit 70 and the latch circuit 72.

Although the configurations of either FIGS. 8 or 9 may be suitable for particular applications, the configuration of FIG. 9 can provide a quiescent current many times lower than the configuration of FIG. 8. In some implementations, a quiescent current as low as about one micro-ampere can be obtained for the configuration of FIG. 9.

Figure 10:
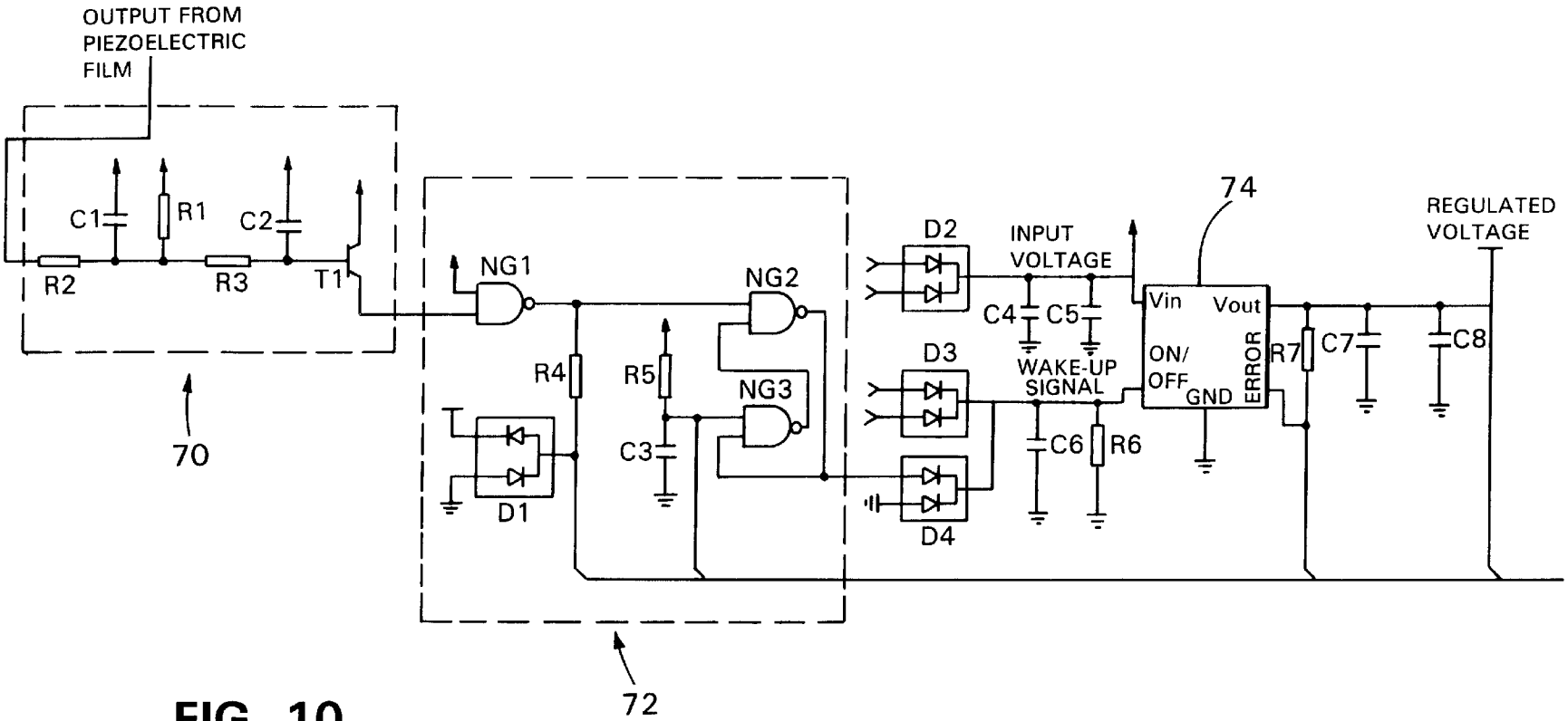
FIG. 10 illustrates details of an exemplary circuit for implementing the configuration of FIG. 9.

FIG. 10 illustrates an exemplary circuit for implementing the configuration of FIG. 9. The high impedance switch circuit 70 includes a transistor T1 which serves as the switching element whose state is controlled by the output of the piezoelectric film sensor 22. The switch circuit also includes several resistors R1, R2, R3 and capacitors C1, C2 which serve as a filter to reduce noise. The output of the transistor T1 serves as an input to a NAND gate NG1 in the latch circuit 72. The NAND gate NG1 is powered by an input voltage and has an output which is clamped by a pair of diodes D1 and a resistor R4 to a regulated voltage. Two additional NAND gates NG2, NG3 form a flip-flop which can be set as a result of the transistor T1 changing state or reset by a signal from the microcontroller 76. A resistor R5 and capacitor C3 provide a turn-on delay for the reset signal from the microcontroller 76. In one embodiment, the switch circuit 70 and the latch circuit 72 can be provided, along with other electronics, on a circuit board secured to the deck of the coin mechanism opposite the lid 26.

Still referring to FIG. 10, the output of the latch 72 is provided to an ON/OFF pin of the voltage regulator 74. The voltage regulator 74 also receives an input voltage at the pin $V_{in}$ from a power supply (not shown). When the latch 72 is set, the regulated voltage is provided from an output pin ($V_{out}$) of the voltage regulator 74 to the microcontroller 76 which controls the coin validation circuitry. The capacitors C7, C8 serve as a filter for the regulated voltage. When the latch 72 is reset by the microcontroller 76, the regulated voltage is turned off. A resistor R7 serves as a pull-up to an ERROR pin which provides a signal to the microcontroller 76 to indicate whether the voltage regulator 74 is functioning properly.

Input signals provided through the diodes D3, D4 can be used during testing of the system to override the signal from the sensor 22 and place the system in a powered-up mode regardless of the output signal from the piezoelectric film sensor.

As described above, a coin inserted into the coin mechanism falls onto the coin debounce device 14 which absorbs or dissipates most of the coin's kinetic energy so that the coin rolls substantially smoothly along a track 16 past the coin identification sensors 18, 20. In other implementations, the coin debounce device 14 can be replaced by a block of material which does not substantially reduce bouncing of the coin. Even in such situations, when the coin strikes the block of material, micro-movement of the block of material is sensed by the piezoelectric film sensor 22 as discussed above. The block of material, thus, serves as an energy transfer device by transferring at least some of the coin's kinetic energy to be sensed by the piezoelectric film sensor 22.

The coin mechanism can be used in various coin-operated devices such as pay telephones and vending machines. Power can be supplied to the voltage regulator 74, the high impedance switch 70, the latch 72 and the sensor 22, for example, from the payphone chassis or the vending machine. The coin mechanism can be used in other coin-operated device as well, including parking meters.

Other implementations are within the scope of the claims.

What is claimed is:

1. A coin mechanism comprising:

a coin path including:

a coin track; and an energy transfer device having an upper surface arranged to be struck by a coin traveling along the coin path;

a piezoelectric film sensor in contact with the energy transfer device, wherein when a coin strikes the energy transfer device, movement of the energy transfer device deflects the piezoelectric film sensor, thereby causing a change in an output signal from the sensor; and a circuit to process the output signal from the piezoelectric film sensor, wherein the coin mechanism changes from a quiescent mode of operation to an active mode of operation in response to the output signal from the piezoelectric film sensor indicating the presence of a coin in the coin path.

2. A coin mechanism comprising:

a coin path including:

a coin track; and an energy transfer device having an upper surface arranged to be struck by a coin traveling along the coin path;

a piezoelectric film sensor including a plurality of bends, wherein when a coin strikes the energy transfer device, movement of the energy transfer device deflects the piezoelectric film sensor, thereby causing a change in an output signal from the sensor; and a circuit to process the output signal from the piezoelectric film sensor, wherein the coin mechanism changes from a quiescent mode of operation to an active mode of operation in response to the output signal from the piezoelectric film sensor indicating the presence of a coin in the coin path.

3. The coin mechanism of claim 2 further including a lid, wherein the coin track and the energy transfer device are located on a first side of the lid, and wherein the lid includes a first slot through which a portion of the piezoelectric film sensor passes to a second side of the lid.

4. The coin mechanism of claim 3 wherein the lid includes a second slot to increase deflection of the piezoelectric film sensor caused by movement of the energy transfer device.

5. A coin mechanism comprising:

a coin path including:

a coin track; and a coin debounce device having an upper surface arranged to be struck by a coin traveling along the coin path;

a piezoelectric film sensor in direct contact with the coin debounce device, wherein when a coin strikes the coin debounce device, movement of the coin debounce device deflects the piezoelectric film sensor, thereby causing a change in an output signal from the sensor; and a circuit to process the output signal from the piezoelectric film sensor, wherein the coin mechanism changes from a quiescent mode of operation to an active mode of operation in response to the output signal from the piezoelectric film sensor indicating the presence of a coin in the coin path.

6. A coin mechanism comprising:

a coin path including:

a coin track; and a coin debounce device having an upper surface arranged to be struck by a coin traveling along the coin path;

a piezoelectric film sensor including a plurality of bends, wherein when a coin strikes the coin debounce device, movement of the coin debounce device deflects the piezoelectric film sensor, thereby causing a change in an output signal from the sensor; and a circuit to process the output signal from the piezoelectric film sensor, wherein the coin mechanism changes from a quiescent mode of operation to an active mode of operation in response to the output signal from the piezoelectric film sensor indicating the presence of a coin in the coin path.

7. The coin mechanism of claim 6 further including a lid, wherein the coin track and the coin debounce device are located on a first side of the lid, and wherein the lid includes a first slot through which a portion of the piezoelectric film sensor passes to a second side of the lid.

8. The coin mechanism of claim 7 wherein the lid includes a second slot to increase deflection of the piezoelectric film sensor caused by movement of the coin debounce device.

9. The coin mechanism of claim 7 wherein electrical connections from the piezoelectric film sensor to the circuit that processes the output signal are connected to a section of the piezoelectric film sensor located on the second side of the lid.

10. The coin mechanism of claim 9 wherein the second side of the lid includes a projection, and wherein the section of the piezoelectric film sensor to which the electrical connections are connected includes a hole which fits over the projection to help retain the piezoelectric film sensor in place.

11. The coin mechanism of claim 9 wherein the piezoelectric film sensor includes a first section disposed between the coin debounce device and the lid and a second section adjacent a lower surface of the coin debounce device.

12. The coin mechanism of claim 11 wherein the first section of the piezoelectric film sensor includes tabs to position the piezoelectric film sensor.

13. The coin mechanism of claim 12 including lugs molded to the first side of the lid for positioning the tabs of the piezoelectric film sensor.

14. The coin mechanism of claim 11 wherein the second section of the piezoelectric film sensor is supported by a ledge secured to the first side of the lid.

15. The coin mechanism of claim 11 wherein the lid includes a second slot located adjacent the first section of the piezoelectric film sensor.

16. The coin mechanism of claim 6 further including a coin identification sensor past which a coin travels as the coin moves along the coin track, wherein the coin identification sensor is positioned downstream of the coin debounce device.

17. The coin mechanism of claim 6 wherein the coin track has an upper surface and wherein the upper surface of the coin debounce device is substantially in line with the upper surface of the coin track.

18. The coin mechanism of claim 6 further including a lid, wherein the coin track and the coin debounce device are located on a first side of the lid, and wherein a section of the piezoelectric film sensor is supported by a ledge secured to the first side of the lid.

19. The coin mechanism of claim 18 wherein the piezoelectric film sensor and the coin debounce device are secured to the lid.

20. The coin mechanism of claim 19 wherein the piezoelectric film sensor and the coin debounce device include substantially aligned holes for receiving a fastening rod to secure the piezoelectric film sensor and the coin debounce device to the lid.

21. The coin mechanism of claim 6 including a controller which receives a wake-up signal when the output signal from the piezoelectric film sensor indicates the presence of a coin in the coin path, and wherein, in response to the wake-up signal, the controller changes from a low-power mode to a powered-up mode to allow coin validation functions to be performed.

22. The coin mechanism of claim 21 including a latch having a set condition, in which the wake-up signal is provided to the controller, and a reset condition, wherein the controller causes the latch to be reset after completion of the coin validation functions.

23. The coin mechanism of claim 21 further including a power supply for providing power to the controller, wherein the power supply can receive the wake-up signal and wherein the power supply provides the power to the controller in response to receiving the wake-up signal.

24. A method of using a coin mechanism, the method including:

receiving a coin in the coin mechanism;

causing the coin to strike a coin debounce device as it travels along a coin path;

causing a piezoelectric film sensor in direct contact with the coin debounce device to be deflected when the coin debounce device moves in response to being struck by the coin;

providing an output signal from the piezoelectric film sensor to indicate presence of the coin in the coin path; and causing the coin mechanism to change from a quiescent mode of operation to an active mode of operation in response to the output signal from the piezoelectric film sensor.

25. The method of claim 24 wherein causing the coin mechanism to change from a quiescent mode of operation to an active mode of operation includes causing a controller to change from a low-power mode of operation to a high-power mode of operation in response to the output signal from the piezoelectric film sensor.

26. The method of claim 25 further including performing coin validation functions once the controller is in the high-power mode of operation.

27. The method of claim 24 further including providing power to a controller in the coin mechanism in response to the output signal from the piezoelectric film sensor.

28. A coin mechanism comprising:

a coin path including:

a coin track; and a coin debounce device having an upper surface arranged to be struck by a coin traveling along the coin path;

a piezoelectric film sensor, wherein when a coin strikes the coin debounce device, movement of the coin debounce device deflects the piezoelectric film sensor, thereby causing a change in an output signal from the sensor;

a lid having a first slot through which a portion of the piezoelectric film sensor passes and a second slot to increase deflection of the piezoelectric film sensor caused by movement of the coin debounce device; and a circuit to process the output signal from the piezoelectric film sensor, wherein the coin mechanism changes from a quiescent mode of operation to an active mode of operation in response to the output signal from the piezoelectric film sensor indicating the presence of a coin in the coin path.

29. A coin mechanism comprising:

a coin path including:

a coin track; and a coin debounce device having an upper surface arranged to be struck by a coin traveling along the coin path;

a piezoelectric film sensor, wherein when a coin strikes the coin debounce device, movement of the coin debounce device deflects the piezoelectric film sensor, thereby causing a change in an output signal from the sensor;

a circuit to process the output signal from the piezoelectric film sensor;

a controller; and a power supply for providing power to the controller, wherein the power supply receives a wake-up signal from the circuit when the output signal from the piezoelectric film sensor indicates the presence of a coin in the coin path, and wherein, in response to the wake-up signal, the power supply causes the controller to enter a powered-up mode to allow coin validation functions to be performed.

30. A method of using a coin mechanism, the method including:

inserting a coin into the coin mechanism;

causing the coin to strike a coin debounce device as it travels along a coin path;

causing a piezoelectric film sensor having a plurality of bends to be deflected when the coin debounce device moves in response to being struck by the coin;

providing an output signal from the piezoelectric film sensor to indicate presence of the coin in the coin path; and causing the coin mechanism to change from a quiescent mode of operation to an active mode of operation in response to the output signal from the piezoelectric film sensor.

31. A method of using a coin mechanism, the method including:

receiving a coin in the coin mechanism;

causing the coin to strike a coin debounce device as it travels along a coin path;

causing a piezoelectric film sensor to be deflected when the coin debounce device moves in response to being struck by the coin;

providing an output signal from the piezoelectric film sensor to indicate presence of the coin in the coin path;

providing a wake-up signal to a power supply in response to the output signal indicating the presence of a coin in the coin path; and providing power to a controller in response to the wake-up signal to cause the controller to enter a powered-up mode to allow coin validation functions to be performed.

* * * * *